US005682995A

United States Patent [19]

Sutherland

[11] Patent Number: 5,682,995

[45] Date of Patent: Nov. 4, 1997

[54] WRAP-AROUND CARRIER WITH BAR CODE BLOCKING PANELS

[75] Inventor: Robert L. Sutherland, Kennesaw, Ga.

[73] Assignee: Riverwood International Corporation, Atlanta, Ga.

[21] Appl. No.: 709,429

[22] Filed: Sep. 6, 1996

[51] Int. Cl.[6] ..... B65D 65/00

[52] U.S. Cl. ..... 206/429; 206/434; 206/140

[58] Field of Search ..... 206/427, 429, 206/434, 153, 140

[56] References Cited

U.S. PATENT DOCUMENTS

| | | | |
|---|---|---|---|
| 4,096,985 | 6/1978 | Wood | 206/427 |
| 4,215,781 | 8/1980 | Humphries et al. | 206/434 |
| 5,000,313 | 3/1991 | Oliff | 206/140 |
| 5,131,588 | 7/1992 | Oliff | 206/427 |
| 5,180,054 | 1/1993 | Bakx | 206/434 |
| 5,297,673 | 3/1994 | Sutherland | 206/427 |
| 5,328,030 | 7/1994 | Sutherland | 206/429 |
| 5,472,090 | 12/1995 | Sutherland | 206/140 |
| 5,542,536 | 8/1996 | Sutherland | 206/427 |
| 5,558,212 | 9/1996 | Sutherland | 206/427 |
| 5,558,213 | 9/1996 | Sutherland | 206/427 |

*Primary Examiner*—Paul T. Sewell
*Assistant Examiner*—Nhan T. Lam

[57] ABSTRACT

A wrap-around carrier with end panel flaps which block the price code on adjacent packaged articles. The end panel flaps are connected to the side panels along angled fold lines which bias the end panel flaps in position against adjacent articles. This results in a small gap between the end panels and the bottom panel which is covered by flaps connected to the end panel flaps. The cover flaps are connected to tuck flaps which lie between the bottom panel and an associated cover flap. The articles rest on the cover flaps, holding them, and thus the connected end panel flaps as well, in place.

2 Claims, 3 Drawing Sheets

WRAP-AROUND CARRIER WITH BAR CODE BLOCKING PANELS

FIELD OF THE INVENTION

This invention relates to wrap-around article carriers. More particularly, it relates to wrap-around carriers which include partial end panels capable of blocking the price code printed on the end articles in the carrier.

BACKGROUND OF THE INVENTION

Certain types of articles, such as food or beverage containers, are commonly sold either as individual units or in a multi-container carton. Each article is normally marked with a bar price code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred to provide wrap-around carriers with partial end panels of a size sufficient to cover the price code on the end articles in the package. Such a design requires less stock than a fully enclosed carrier and is correspondingly more economical to produce. Ideally, the partial end panels should be large enough to cover the price code of the end articles, should not interfere with the normal fabrication and packaging methods of wrap-around carriers and should be locked in place after being formed. Even when such criteria are met, however, it is difficult to hold the end panels tightly in place against the articles. It is desirable that the end panels act to prevent outward movement of the articles in addition to performing a blocking function.

The main object of the invention, therefore, is to provide a wrap-around carrier with an improved partial end panel design which covers the price code of end articles and is maintained tightly against the adjacent articles.

BRIEF SUMMARY OF THE INVENTION

The invention is embodied in a package formed of a wrap-around carrier containing a plurality of rows of adjacent articles. In addition to the basic wrap-around structure in which side panels are foldably connected to a top panel and to a bottom panel formed of bottom panel flaps, an end panel flap is connected by fold line to each of the end edges of the side panels and a bottom cover flap is connected by fold line to each end panel flap. Each bottom cover flap is connected by fold line to a tuck flap, which in turn is connected by fold line to an associated bottom panel flap. The tuck flaps are folded so that they lie between an associated bottom cover flap and an associated bottom panel flap. Each bottom cover flap extends into the interior of the carrier and engages the bottom of an adjacent article.

By this means the partial end panels formed by the end panel flaps cover the price code on the lower portions of the end articles, preventing the code from being detected by a price scanner. Further, the weight of the articles resting on the bottom cover flaps holds the tuck flaps in place, thereby also holding the end panel flaps in closed condition.

In a preferred arrangement the fold line connecting an end panel flap to a side panel forms an acute angle with the fold line connecting the side panel to the bottom panel. While this results in the end panel flaps being tightly held against the end articles, it causes the bottom panel flaps to be spaced from the end panel flaps. The bottom cover flaps extend across this space opposite the end articles, thereby also functioning to prevent the scanner from detecting the price code on the articles through the space.

The carrier is readily and economically formed from a single blank, the details of which are described below.

The above and other aspects and benefits of the invention will be readily apparent from the more detailed description of the preferred embodiment of the invention which follows.

DETAILED DESCRIPTION OF THE PREFERRED EMBODIMENT

Figure 1:
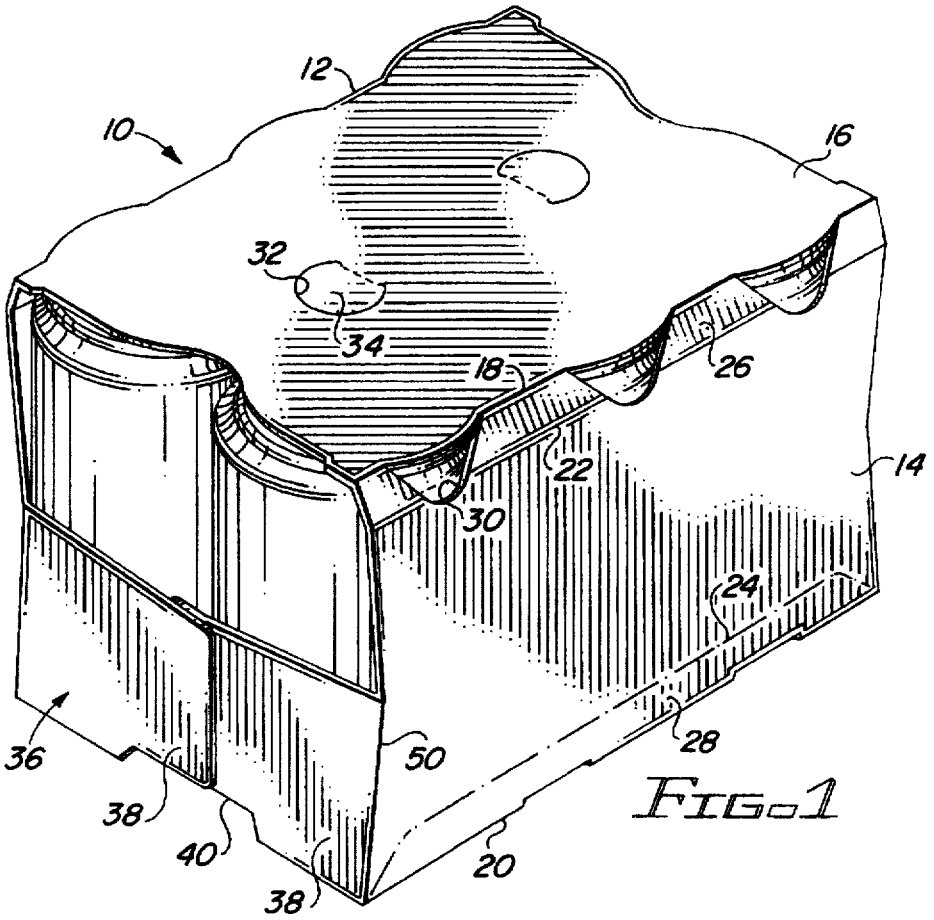
FIG. 1 is a pictorial view of the package of the invention.

Referring to FIG. 1, a package 10 is comprised of wrap-around carrier 12 containing six beverage cans C supported on the bottom panel of the carrier. Side panels 14 are connected to top panel 16 by fold line 18 and to the bottom panel by fold line 20. The upper portion of each side panel includes score line 22, and the lower portion of each side panel includes score line 24, spaced from the fold lines 18 and 20, respectively. The area between fold line 18 and score line 22 comprises sloped shoulder panel 26, and the area between the fold line 20 and score line 24 comprises sloped heel panel 28. These sloped panels enable the carrier to be more tightly wrapped around the cans by more closely conforming to the tapered top and bottom portions of the cans. Openings 30 in the shoulder panels 26, which extend slightly into the top panel, are located opposite each can and allow the flanges F of the cans to extend beyond the shoulder panels to further facilitate the tight fit of the carrier. Finger holes 32 in the top panel, which are covered by foldable tabs 34, may be used as a handle when lifting the package.

Figure 2:
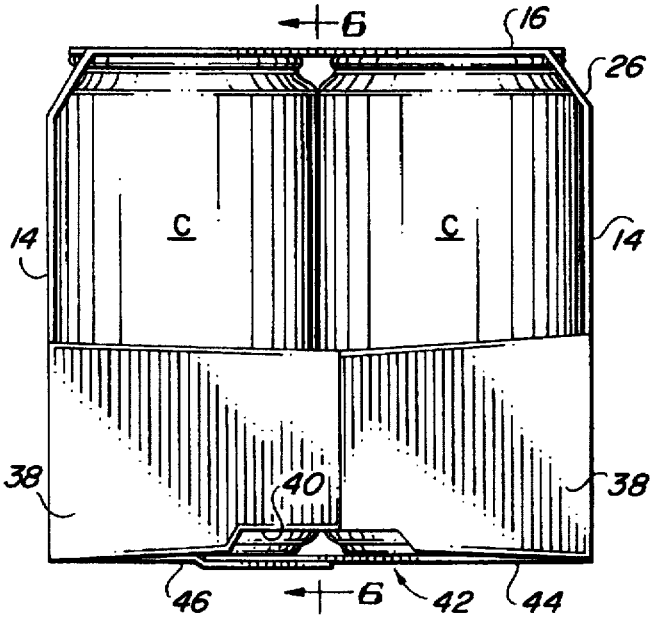
FIG. 2 is an end view of the package.

In addition to the above structure partial end panels 36, comprised of overlapping end panel flaps 38, conceal the lower portion of the cans where the price code is located. As shown in FIG. 2, the end panel flaps are notched at 40 to form a cutout in order to avoid contact between the end panel flaps and the dead plate on a packaging machine. The bottom panel 42 of the carrier can be seen in FIG. 2 to be comprised of inner and outer bottom panel flaps 44 and 46, respectively, which are mechanically connected by structure described below.

Figure 3:
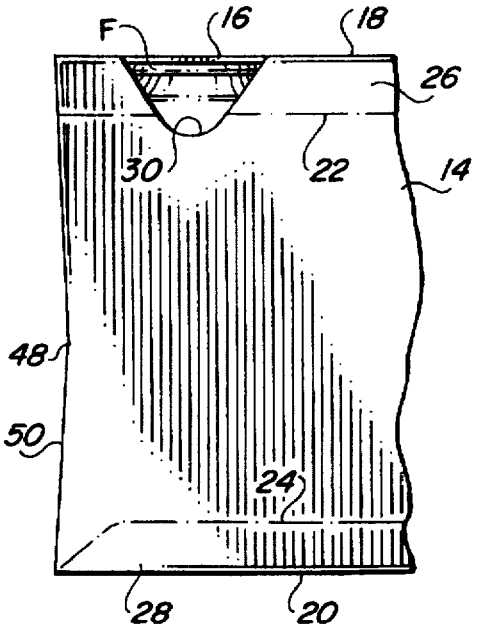
FIG. 3 is a partial side elevation of the package.

As best shown in FIG. 3, the top and bottom panels terminate at their ends in substantially the same vertical plane, but the ends of the side panels 14 are angled so as to converge at point 48. The end panel flaps 38 are connected to the side panels 14 along angled fold lines 50 which extend from the bottom panel to the point 48. As explained further below, this arrangement results in a small gap between the ends of the bottom panel and the lower ends of the end panel flaps through which a price scanner could possibly detect the price code on an outer article in the package. Additional structure, not visible in the views shown thus far, is provided to prevent erroneous price detection by blocking the gap.

Figure 4:
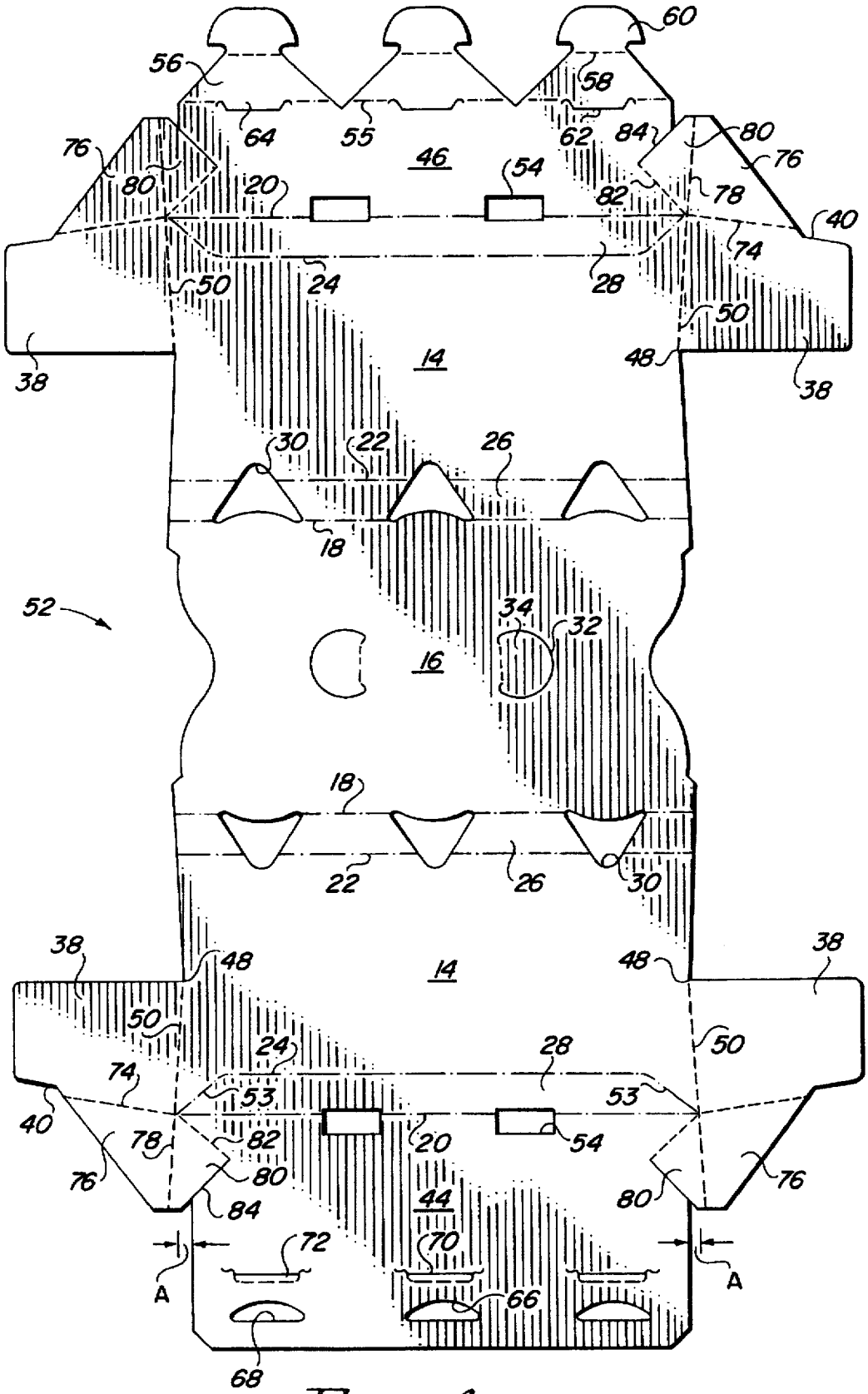
FIG. 4 is a plan view of a blank used to form the carrier of FIG. 1.

Referring now to FIG. 4, wherein like reference numerals to those used in FIGS. 1–3 denote similar elements, a blank 52 capable of being fabricated into the carrier of FIG. 1 includes a centrally located top panel section 16 connected at opposite sides along the score lines 18 to the side panel sections 14. One of the side panel sections is connected by fold line 20 to the inner bottom panel flap 44 and other side panel section is connected by fold line 20 to the outer bottom panel flap 46. The cutouts 30, the shoulder and heel panels 26 and 28 and the end panel flaps 38 are indicated on the blank as described above. Instead of the score line 24 extending across the side panels sections in a continuous straight line, it is angled at each end, as at 53, terminating at the intersection of fold lines 20 and 50. In addition, each bottom panel flap includes cutouts 54 which provide access to mechanical fingers on a packaging machine for tightening the bottom panel flaps prior to forming the bottom panel.

The outer bottom panel flap 46 contains fold line 55 connecting secondary locking tabs 56 to the flap. Each secondary locking tab includes an intermediate fold line 58 which forms an outer tab portion 60. Interrupting the fold line 55 opposite each secondary locking tab are spaced slits 62 which form primary locking tabs 64. As illustrated, adjacent edges of the secondary locking tabs continue into the bottom panel flap 46 as converging slits which also interrupt the fold line 55. The inner bottom panel flap 44 includes cutouts 66 having primary female locking edges 68 adapted to engage the primary male locking tabs 64. Spaced from the cutouts 66 are slits 70 adapted to receive the outer portions 60 of the secondary locking tabs 56. Foldably connected tabs or flaps 72 in the bottom panel flap 44 may be provided to facilitate entry of the secondary locking tabs into the slits 72. Although these various locking elements are illustrated to demonstrate a typical bottom panel locking arrangement suitable for use with the carrier of the invention, it should be understood that any desired effective form of bottom panel locking means may be employed.

Still referring to FIG. 4, the end panel flaps 38 are connected by fold line 74 to bottom cover flaps 76. Connected to the cover flaps 76 by fold lines 78 are tuck flaps 80. The tuck flaps are also connected to the bottom panel flaps 44 and 46 by angled fold lines 82 and are connected by slits 84 to the end of the fold lines 82. The fold lines 74 form obtuse angles with the fold lines 20, and the fold lines 78 form slight obtuse angles with the fold lines 50. Associated fold lines 20, 50, 74, 78 and 82 meet at a common point of intersection.

Figure 5:
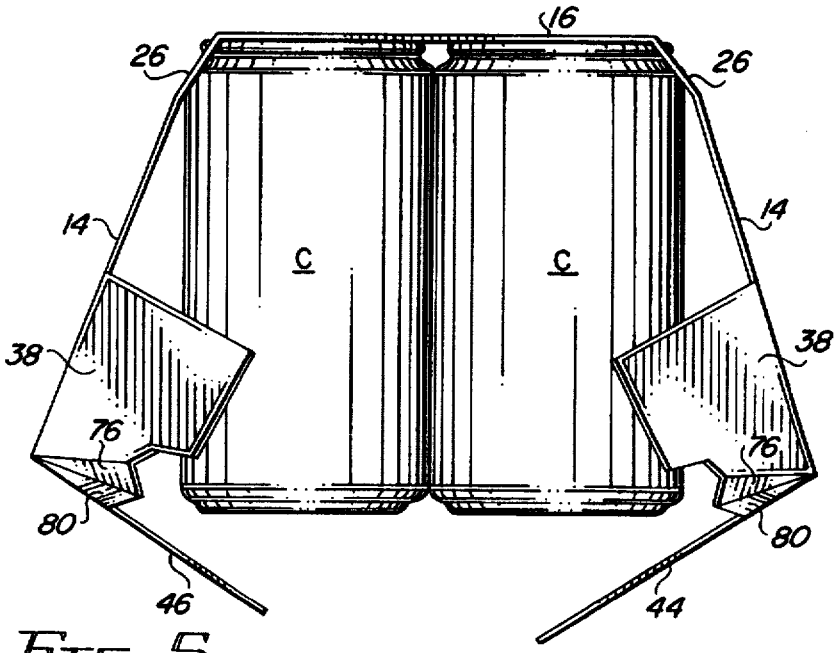
FIG. 5 is an end view of a carrier at an interim stage of fabrication.

To form a package of beverage cans, the cans are grouped together as they are to be arranged in the package and the top panel section of the blank is aligned with the cans and placed on top of them. The blank is then folded down about the score lines 18, pivoting the side panel sections and bottom panel flaps. As this takes place upward pressure on the fold lines 78 causes the cover flaps 76 and the tuck flaps 80 to fold inwardly toward the interior of the carrier. FIG. 5 illustrates the blank at an interim stage during this folding process. It can be seen that the cover flaps 76 and the tuck flaps 80 have been folded inwardly to an extent from the end panel flaps 38 and the bottom panel flaps 44 and 46. As the folding process continues and the bottom panel flaps 44 and 46 are inwardly pivoted, the inward folding of the tuck flaps 80 is completed, resulting in the cover flaps 76 being folded up beneath adjacent cans and the tuck flaps being folded up to a position between the cover flaps and the bottom panel flaps. This final position is illustrated in FIG. 6.

Figure 7:
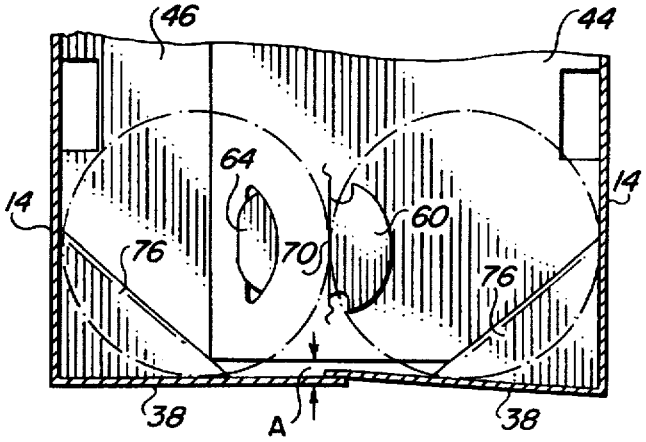
FIG. 7 is a partial transverse sectional view of the interior of a carrier, with the beverage cans shown in broken lines.
Figure 8:
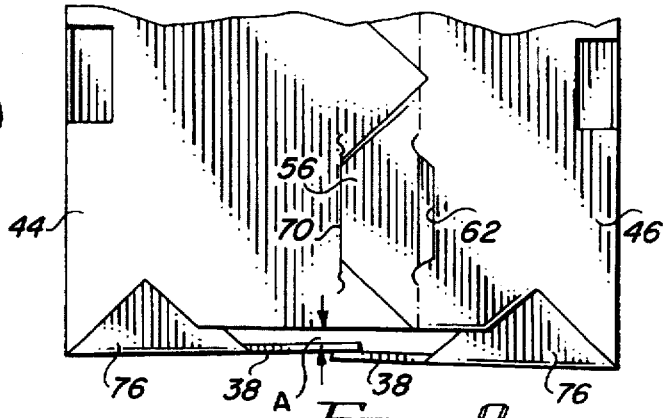
FIG. 8 is a partial bottom view of the carrier.

The final step in the formation of the package is to lock the bottom panel flaps together. The details of this phase of the operation have not been illustrated since the particular locking mechanism employed does not form part of the invention. It will be understood by those familiar with the locking elements shown, however, that the secondary locking tabs 56 of bottom panel flap 46 are folded back about the fold line 54 and the primary male locking tabs 64 are engaged with the primary female locking edges 68 in bottom panel flap 44. The secondary male locking tab portions 60 are then inserted through the slits 72 of the flap 44 to complete the mechanical locking action, resulting in the package of FIG. 1. The interior of the carrier, with the cans illustrated in broken lines, is shown in FIG. 7. The bottom of the carrier is illustrated in FIG. 8.

Figure 6:
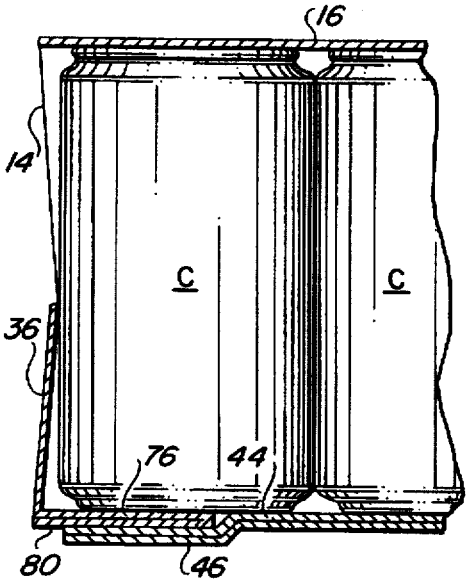
FIG. 6 is a partial longitudinal sectional view taken on line 6—6 of FIG. 2.

As shown in FIGS. 6 and 7, the end cans in the package partially rest on the cover flaps 76, thereby locking in place both the cover flaps and the tuck flaps 80, which are folded between the bottom panel and the cover flaps. The locked condition of the cover flaps 76 also holds the end panel flaps 38 in closed position. Since the upper portions of the cans are gripped at the cutouts 30 and cannot move past the fixed end panel flaps, the cans are held substantially immovable in the carrier.

As previously noted, the fold lines 50 connecting the end panel flaps to the side panels are angled inwardly so that they form an acute angle with the fold line 20 connecting the associated side panel section 14 to the adjacent bottom panel flap. This angled hinge causes the end panel flaps to be biased against the cans. However, as indicated in FIG. 4 by the measurement A, the end panels when formed are spaced from the end of the bottom panel by this amount. This spatial arrangement can also be seen by the measurement A in the illustrations of the formed carrier in FIGS. 7 and 8. Depending on the angle at which the package is held during the price scanning procedure, if it were not for the cover flaps 76 it could be possible for a price scanner to detect the price code on an individual can through this gap. The bottom cover flaps, however, cover the gap opposite the end can locations, thereby blocking the line of sight of a price scanner in this area. It can be seen in FIG. 8 that the cover flaps 76 also block the openings in the bottom panel flaps formed when the tuck flaps 80 are pivoted about the fold lines 82 out of the plane of the bottom panel flaps. Note in FIG. 2 that the cutouts 40 in the lower edge of the end panel flaps are not sufficiently large or located in such a way as to allow a price scanner to see a price code on an end can.

As indicated, the shoulder and heel panels 26 and 28 allow the side panels of the carrier to be more tightly pulled about the inwardly tapered upper and lower portions of the cans. While the score lines 22 forming the shoulder panels extend to the ends of the side panels, the score lines 24 forming the heel panels do not. If they extended out to the ends of the side panels, which would be at the fold lines 50, the inwardly folded heel panels would interfere with the condition of the end panel flaps. The score lines 24 are therefore completed by the angled score lines 53 which terminate at the bottom of the end panel flaps. This arrangement allows the heel panels to function as desired without interfering with the folding and inward bias of the end panel flaps 38.

It is not necessary for the various fold line angles to be of any particular degree. The fold lines 78 and 82, for example, will be at whatever angles yield bottom cover flaps and tuck flaps of the desired size. As to fold line 50, it is preferred that it form an acute angle with the fold line 20 of the associated side panel in order to provide the biased end panel flap arrangement discussed, but no particular angle need be employed. The fold lines 50, 74, 78 and 82 defining the end panel flaps, the bottom cover flaps and the tuck flaps and the fold lines 20 and 53 should meet at a substantially common point to enable the folding steps described to take place.

While the various folding steps can be carried out by hand it is contemplated that they would be carried out in a packaging machine as the cans and blank are continuously moving through the machine. In that event the flaps 38, 76 and 80 would be engaged and moved by suitable packaging machine elements in order to fold the flaps. Neither the packaging machine nor the folding elements of the machine have been shown since the various mechanical movements required in order to fold the panels of a carrier into place are well within the scope of one skilled in the packaging machine art.

Although the invention has been described in connection with a carrier designed to hold six cans, it obviously may be incorporated in carriers designed to hold more or less than that and can be utilized with other types of articles as well. The carriers are economical, simple to fabricate, provide end restraints against outward movement of the articles and cover the bar code on the end articles to prevent inadvertent price scanning.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention as defined in the appended claims.

What is claimed is:

1. A package comprised of a wrap-around carrier containing a plurality of rows of adjacent articles, each article having a top and a bottom, comprising:

opposite side panels connected to a top panel, each side panel being connected by a fold line to a bottom panel flap, the bottom panel flaps being connected to each other to form a bottom panel, the bottom panel flaps and the side panels having opposite end edges;

an end panel flap connected by a fold line to each of the end edges of the side panels;

a bottom cover flap connected by a fold line to each end panel flap, each bottom cover flap extending into the interior of the carrier and engaging the bottom of an adjacent article;

a tuck flap connected by a fold line to each bottom cover flap, each tuck flap also being connected by a fold line to an associated bottom panel flap;

each tuck flap lying between an associated bottom cover flap and an associated bottom panel flap; and each side panel including a score line spaced from the fold line connecting the side panel to the associated bottom panel flap, said spaced score line including downwardly angled end portions which substantially intersect the fold line connecting the side panel to the associated bottom panel flap and the fold lines connecting associated end panel flaps to the side panel.

2. A blank for forming a carrier for packaging a plurality of rows of adjacent articles, comprising:

a sheet having a centrally located top panel section;

side panel sections connected to opposite sides of the top panel section by a fold line, the side panel sections having opposite end edges;

a bottom panel flap connected to each side panel section by a fold line;

an end panel flap connected by a fold line to each of the end edges of the side panel sections;

a bottom cover flap connected by a fold line to each end panel flap;

a tuck flap connected by a fold line to each bottom cover flap, each tuck flap also being connected by a fold line to an associated bottom panel flap;

the bottom cover flaps and the tuck flaps being arranged so that in a carrier formed from the blank each bottom cover flap extends into the interior of the carrier beneath an adjacent article and the associated tuck flap lies between the bottom cover flap and the associated bottom panel flap; and each side panel section including a score line spaced from the fold line connecting the side panel section to the associated bottom panel flap, said spaced score line including angled end portions which substantially intersect the fold line connecting the side panel section to the associated bottom panel flap and the fold lines connecting associated end panel flaps to the side panel section.

* * * * *